US006141601A

United States Patent [19]

Baek

[11] Patent Number: 6,141,601

[45] Date of Patent: Oct. 31, 2000

[54] METHOD AND APPARATUS FOR CONTROLLING AN IGNITION OF A GAS BOILER

[75] Inventor: Sung-Hak Baek, Seoul, Rep. of Korea

[73] Assignee: Daewoo Electronics Co., Ltd., Seoul, Rep. of Korea

[21] Appl. No.: 09/037,499

[22] Filed: Mar. 10, 1998

[30] Foreign Application Priority Data

Mar. 28, 1997 [KR] Rep. of Korea ..... 97-11088

[51] Int. Cl.[7] ..... G06F 19/00

[52] U.S. Cl. ..... 700/204; 700/205; 700/207; 700/209

[58] Field of Search ..... 700/1, 204, 205, 700/209, 207

[56] References Cited

U.S. PATENT DOCUMENTS

| | | | |
|---|---|---|---|
| 4,000,961 | 1/1977 | Mandock | 700/209 |
| 4,807,144 | 2/1989 | Joehlin | 700/205 |
| 5,026,272 | 6/1991 | Takahashi | 700/205 |
| 5,099,442 | 3/1992 | Furuta | 700/210 |
| 5,507,264 | 4/1996 | Kugler | 700/210 |
| 5,636,978 | 6/1997 | Sasaki | 700/209 |

*Primary Examiner*—Dennis M. Butler
*Attorney, Agent, or Firm*—Pillsbury Madison & Sutro LLP

[57] ABSTRACT

A method and an apparatus for stably controlling an ignition operation of a gas boiler regardless of external conditions by means of a method and an apparatus for variably setting an ignition condition of the gas boiler is disclosed. Control section detects an extinguishment flame voltage value based on whether or not a state of the gas boiler is an extinguishment state, compares the detected extinguishment flame voltage value with a predetermined first reference ignition flame voltage value, and sets a new reference ignition flame voltage value according to the compared result. As a result, the effects on the variations of components' characteristic which occur while using the gas boiler for a long time is minimized. Also, the effects caused by external conditions in the ignition state, the combustion state and the extinguishment state of the gas boiler are minimized. As a result, the ignition operation of the gas boiler is stably executed.

9 Claims, 5 Drawing Sheets

METHOD AND APPARATUS FOR CONTROLLING AN IGNITION OF A GAS BOILER

BACKGROUND OF THE INVENTION

1. Field of the Invention

The present invention relates to a method and an apparatus for stably controlling an ignition operation of a gas boiler regardless of external conditions by means of a method and an apparatus for variably setting an ignition condition of the gas boiler.

2. Description of the Prior Art

In general, a gas boiler which uses gas as fuel heats water using the high temperature generated by the burning gas. The heated water circulates through heating pipes disposed inside a room and produces heat inside the room. The gas which is used as fuel of the gas boiler is burned completely. Consequently, the gas boiler is safe due to the absence of environmental pollution, and is gradually and widely used due to its convenience of use.

FIG. 1 is a configuration view for showing the configuration of a conventional gas boiler.

Referred to FIG. 1, generally, the gas boiler comprises a gas valve 10, a burner 12, a flame voltage detector 14, an ignition plug 16, a ventilation hood 18, a heat exchanger 20, a ventilation fan 22, a circulation pump 26, and a water tank 28.

When a user sets the gas boiler in an operation mode, the gas is supplied to burner 12 through gas valve 10 by a predetermined amount. A high voltage is applied to ignition plug 16 by a microcomputer (not shown) in order to ignite the gas which is supplied to burner 12. When a spark for the ignition is generated from ignition plug 16 due to the high voltage, the gas supplied to burner 12 is ignited and the gas boiler executes a combustion operation.

At this time, flame voltage detector 14 detects a flame voltage value which is generated by a blaze of an ignited state, and provides the detected flame voltage value to the microcomputer. The microcomputer judges whether or not the gas boiler is in an ignition state based on a comparison between the detected flame voltage value and a predetermined ignition flame voltage value. When the gas boiler is in an ignition state, the microcomputer executes a normal combustion operation of the gas boiler, and when the gas boiler is not in an ignition state, the microcomputer executes a re-ignition operation of the gas boiler.

However, in the above-described prior gas boiler, ignition failures frequently occur. Especially, since the components which consist of the gas boiler are different from each other in their characteristics, when the characteristics of the components, e.g., flame voltage detector 14 etc., change while using the gas boiler for a long time, flame voltage detector 14 cannot normally detect the flame voltage value in an ignition state, a combustion state and an extinguishment state of the gas boiler.

Also, in the case where combustion gas is not normally exhausted by an adverse wind which flows into the inside of the gas boiler from the outside through ventilation hood 18 while the ignition operation is being executed, or in the case where the flame is blown by a favorable wind which is supplied to a lower part of burner 12, flame voltage detector 14 cannot accurately detect the flame voltage value.

As a result, although the gas boiler is actually ignited, the microcomputer judges that the gas boiler is not ignited based on an abnormally-detected flame voltage value and repeatedly executes the re-ignition operation of the gas boiler.

SUMMARY OF THE INVENTION

Therefore, it is an object of the present invention to provide a method for stably controlling an ignition operation of a gas boiler regardless of external conditions of the gas boiler.

It is another object of the present invention to provide a method for variably setting an ignition condition of a gas boiler.

It is a further object of the present invention to provide an apparatus for stably controlling an ignition operation of a gas boiler regardless of external conditions of the gas boiler.

It is a further object of the present invention to provide an apparatus for variably setting an ignition condition of a gas boiler.

In order to achieve the above objects, the present invention provides a method for controlling an ignition of a gas boiler, which comprises:

(i) detecting an extinguishment flame voltage value based on whether or not a gas boiler is in an extinguishment state;

(ii) comparing the extinguishment flame voltage value detected in step (i) with a first reference ignition flame voltage value; and (iii) setting a new ignition flame voltage value based on a compared result in step (ii).

In order to achieve the above objects, the present invention provides an apparatus for controlling an ignition of a gas boiler, which comprises:

key inputting means for generating operation setting signals in response to a key operation from a user;

flame voltage detecting means for detecting and for generating an ignition flame voltage value, an extinguishment flame voltage value and a combustion flame voltage value of the gas boiler;

control means for generating either a gas supply starting signal or a gas supply stopping signal in response to the operation setting signals from said key inputting means, for generating a high voltage to generate an igniting spark, for inputting the ignition flame voltage value, the extinguishment flame voltage value and the combustion flame voltage value from said flame voltage detecting means, for executing a re-ignition operation based on a result produced by respectively comparing the inputted ignition flame voltage value and the combustion flame voltage value with a predetermined reference ignition flame voltage value, and for setting to a new reference ignition flame voltage value to execute the re-ignition operation of the gas boiler, either the first reference ignition flame voltage value, or an extinguishment flame voltage value produced by subtracting a compensation voltage value from the extinguishment flame voltage value supplied from said flame voltage detecting means or a third reference ignition flame voltage value produced by subtracting the compensation voltage value from a third reference ignition flame voltage value based on a result produced by respectively comparing the extinguishment flame voltage value from said flame voltage detecting means with first and with second reference ignition flame voltage values during the re-ignition operation;

means for supplying gas to the gas boiler in response to the gas supply starting signal from said control means, and for stopping gas supplied to the gas boiler in response to the gas supply stopping signal from said control means; and ignition plug means for generating the igniting spark of the gas boiler in response to the high voltage from said control means.

In the method and apparatus for controlling an ignition of a gas boiler according to the present invention, the reference ignition flame voltage value of the gas boiler is variably set according to the combustion flame voltage value detected from a combustion state of the gas boiler and to the extinguishment flame voltage value detected from an extinguishment state of the gas boiler.

As a result, the effects on the variations of components' characteristics which occur while using the gas boiler for a long time are minimized. Also, the effects caused by external conditions in the ignition state, the combustion state and the extinguishment state of the gas boiler are minimized. As a result, the ignition operation of the gas boiler is stably executed.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

A description will be given below in detail with reference to the accompanying drawings to a configuration and an operation of a method and an apparatus for controlling an ignition of a gas boiler according to an embodiment of the present invention.

Figure 1:
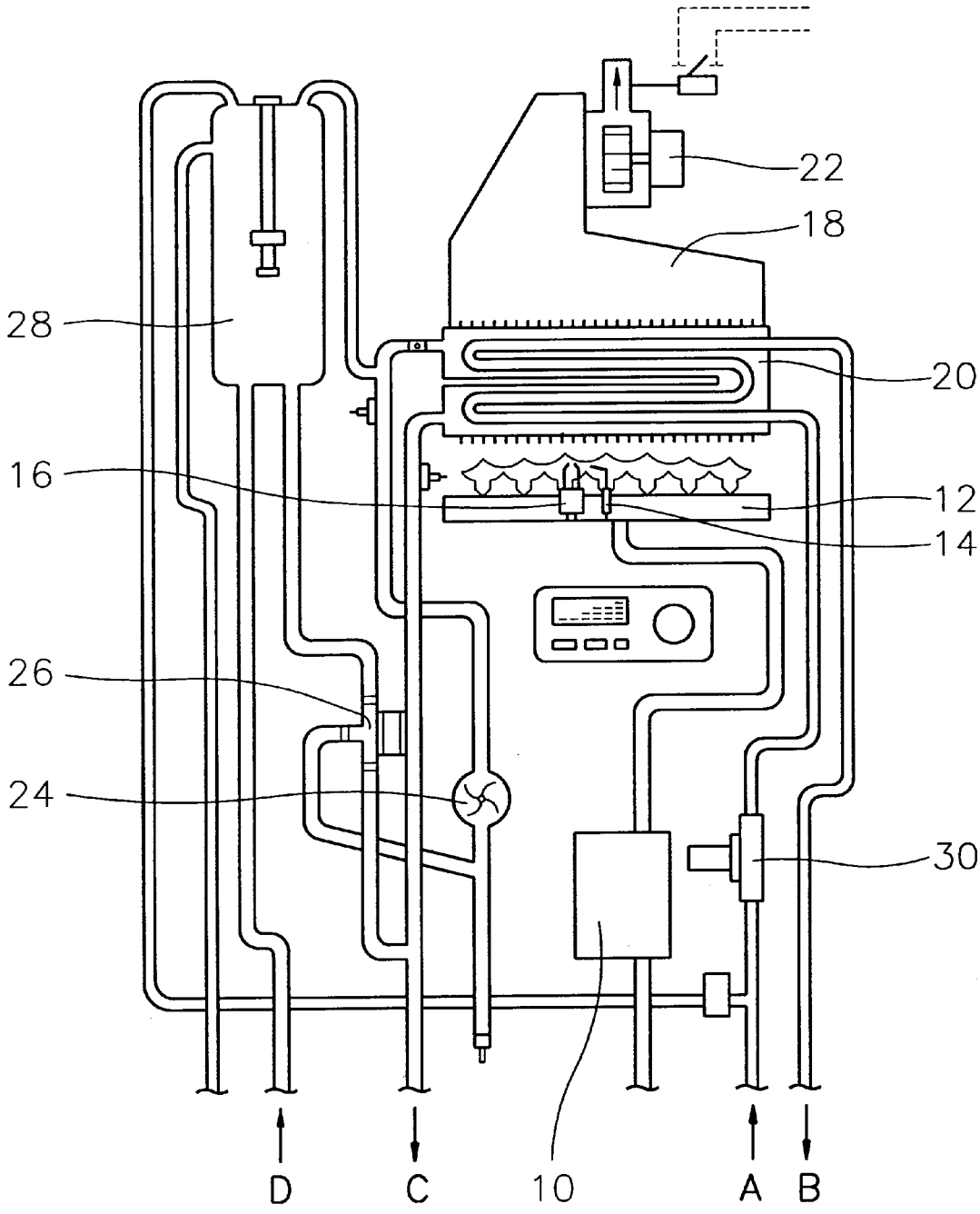
FIG. 1 (PRIOR ART)
FIG. 1 is a configuration view for showing the configuration of a conventional gas boiler.
Figure 2:
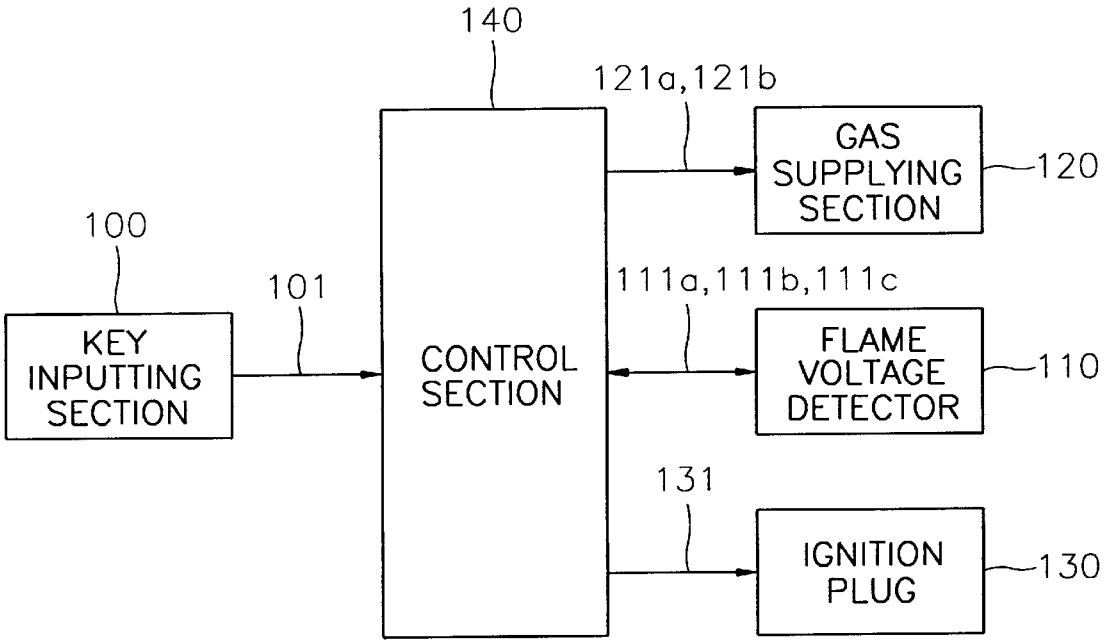
FIG. 2 is a block diagram for showing the configuration of an apparatus for controlling an ignition of a gas boiler according to the present invention.

FIG. 2 is a block diagram for showing the configuration of an apparatus for controlling an ignition of a gas boiler according to the present invention. As shown in FIG. 2, the apparatus for controlling an ignition of a gas boiler comprises a key inputting section 100, a flame voltage detector 110, a gas supply section 120, an ignition plug 130, and a control section 140.

Key inputting section 100 sets operation conditions of the gas boiler through keys thereof and provides operation setting signals 101 which are inputted through the keys by a user to control section 140.

Flame voltage detector 110 detects an ignition flame voltage value, a combustion flame voltage value and an extinguishment flame voltage value in an ignition state, a combustion state and an extinguishment state respectively, and provides a detected ignition flame voltage value 111*a*, combustion flame voltage value 111*b* and extinguishment flame voltage value 111*c* to control section 140.

Gas supply section 120 supplies gas to the gas boiler in response to a gas supply starting signal 121*a* from the control section 140 and stops gas being supplied to the gas boiler in response to a gas supply stopping signal 121*b* from the control section 140.

Ignition plug 130 generates a spark to ignite gas which is supplied to the gas boiler from gas supply section 120 in response to a high voltage 131 from control section 140.

Control section 140 controls an ignition operation, a combustion operation and an extinguishment operation of the gas boiler in response to the operation setting signals 101 from key inputting section 100.

Control section 140 provides gas supply starting signal 121*a* to gas supply section 120 when operation setting signal 101 from key inputting section 100 is an ignition signal of the gas boiler and gas supply section 120 supplies the gas to the gas boiler in response to gas supply starting signal 121*a* from control section 140.

Also, when operation setting signal 101 from the key inputting section 100 is an ignition signal of the gas boiler, control section 140 provides high voltage 131 to ignition plug 130 in order to generate a spark for ignition, and then ignition plug 130 generates the spark for ignition in response to high voltage 131 from control section 140.

When the gas which is supplied from gas supply section 120 to the gas boiler is ignited by the spark generated from ignition plug 130, control section 140 compares ignition flame voltage value 111*a* supplied from flame voltage detector 110 with a predetermined reference ignition flame voltage value.

In addition, after the gas boiler is ignited, control section 140 compares combustion flame voltage value 111*b* supplied from flame voltage detector 110 with the predetermined reference ignition flame voltage value during the combustion operation. At this time, the predetermined reference ignition flame voltage value is 4.5 volts.

Control section 140 judges whether the gas boiler is either in a normal ignition state or in a normal combustion state or in an extinguishment state of the gas boiler based on a result which is produced by comparing ignition flame voltage value 111*a* and combustion flame voltage value 111*b* from flame voltage detector 110 with the predetermined reference ignition flame voltage value, respectively.

For example, when ignition flame voltage value 111*a* and combustion flame voltage value 111*b* supplied from flame voltage detector 110 is not higher than the predetermined reference ignition flame voltage value, the ignition state and the combustion state of the gas boiler are equally normal states. Accordingly, when the gas boiler is in the normal ignition state or in the normal combustion state, control section 140 executes the combustion operation of the gas boiler.

Also, when ignition flame voltage value 111*a* and combustion flame voltage value 111*b* provided from flame voltage detector 110 is higher than the predetermined reference ignition flame voltage value, the gas boiler is in the extinguishment state.

Accordingly, when the gas boiler is in the extinguishment state, control section 140 sets a new reference ignition flame voltage value in order to execute a re-ignition operation of the gas boiler based on a result which is produced by comparing extinguishment flame voltage value 111*c* from flame voltage detector 110 either with a first reference ignition flame voltage value or with a second reference ignition flame voltage value respectively. At this time, the first and the second reference ignition flame voltage values are 4.5 volts and 5 volts, respectively.

When extinguishment flame voltage value 111*c* from flame voltage detector 110 is not higher than the first reference ignition flame voltage value, control section 140 sets the first reference ignition flame voltage value to the new reference ignition flame voltage value in order to execute the re-ignition operation of the gas boiler.

When extinguishment flame voltage value 111*c* from flame voltage detector 110 is higher than the first reference ignition flame voltage value, control section 140 sets the new reference ignition flame voltage value based on a result which is produced by comparing extinguishment flame voltage value 111*c* from flame voltage detector 110 with the second reference ignition flame voltage value.

For example, when extinguishment ignition flame voltage value 111*c* from flame voltage detector 110 is lower than the second reference ignition flame voltage value, control section 140 sets, to the new reference ignition flame voltage value to execute the re-ignition operation of the gas boiler, an extinguishment flame voltage value which is produced by subtracting a compensation voltage value from extinguishment flame voltage value 111*c* which is supplied from flame voltage detector 110. Also, when extinguishment ignition flame voltage value 111*c* from flame voltage detector 110 is not lower than the second reference ignition flame voltage value, control section 140 sets, to the new reference ignition flame voltage value to execute the re-ignition operation of the gas boiler, a third reference ignition flame voltage value which is produced by subtracting the compensation voltage value from the third reference ignition flame voltage value.

Accordingly, control section 140 variably sets the reference ignition flame voltage value of the gas boiler according to ignition flame voltage value 111*a*, combustion flame voltage value 111*b* and extinguishment flame voltage value 111*c* which are respectively provided from flame voltage value 110, and executes the re-ignition operation of the gas boiler automatically.

Also, control section 140 controls the gas boiler to be in the combustion operation until an extinguishment signal of the gas boiler is provided from key inputting section 100. When operation setting signal 101 from key inputting section 100 is the extinguishment signal of the gas boiler, control section 140 provides gas supply stopping signal 121*b* to gas supply section 120, and then gas supply section 120 stops the gas which is supplied to the gas boiler in response to gas supply stopping signal 121*b* from control section 140.

A description will be made next of the procedure of the method for controlling an ignition of a gas boiler which is performed by the apparatus shown in FIG. 2, in accordance with the flowchart of FIGS. 3 to 5.

Figure 3:
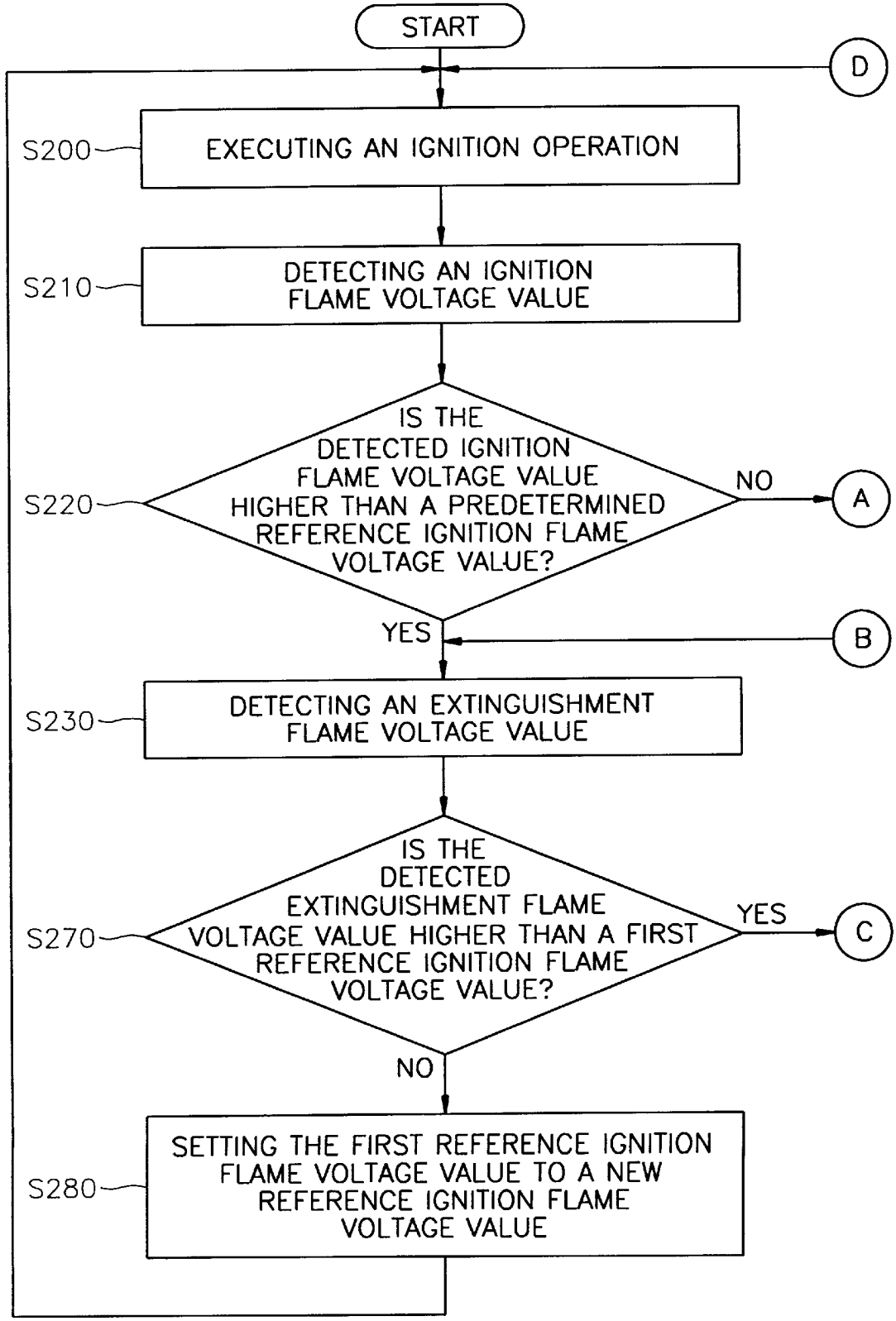
FIGS. 3 to 5 are a flowchart for illustrating a method for controlling an ignition of a gas boiler by using the apparatus shown in FIG. 2.
Figure 4:
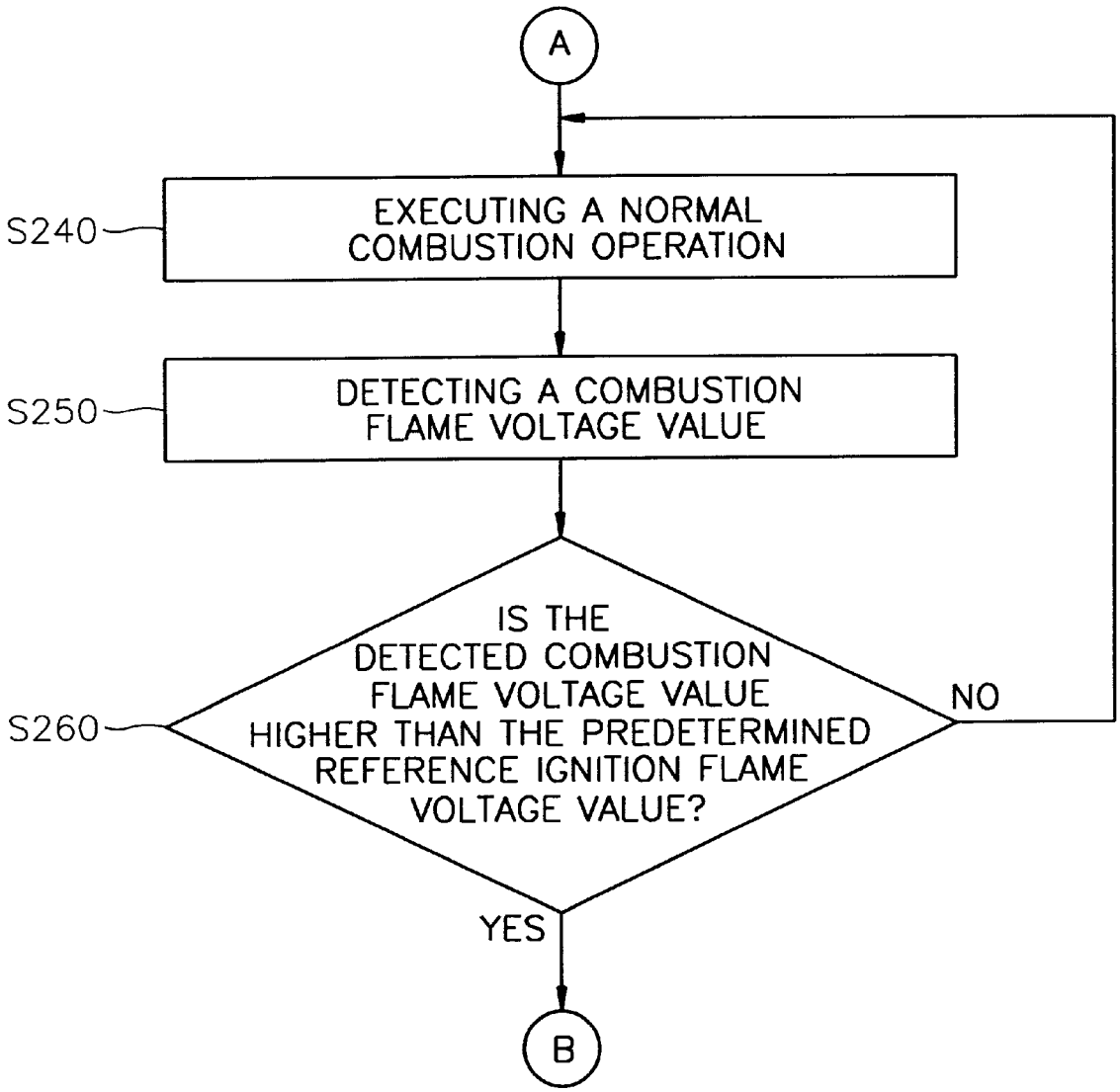
Figure 5:
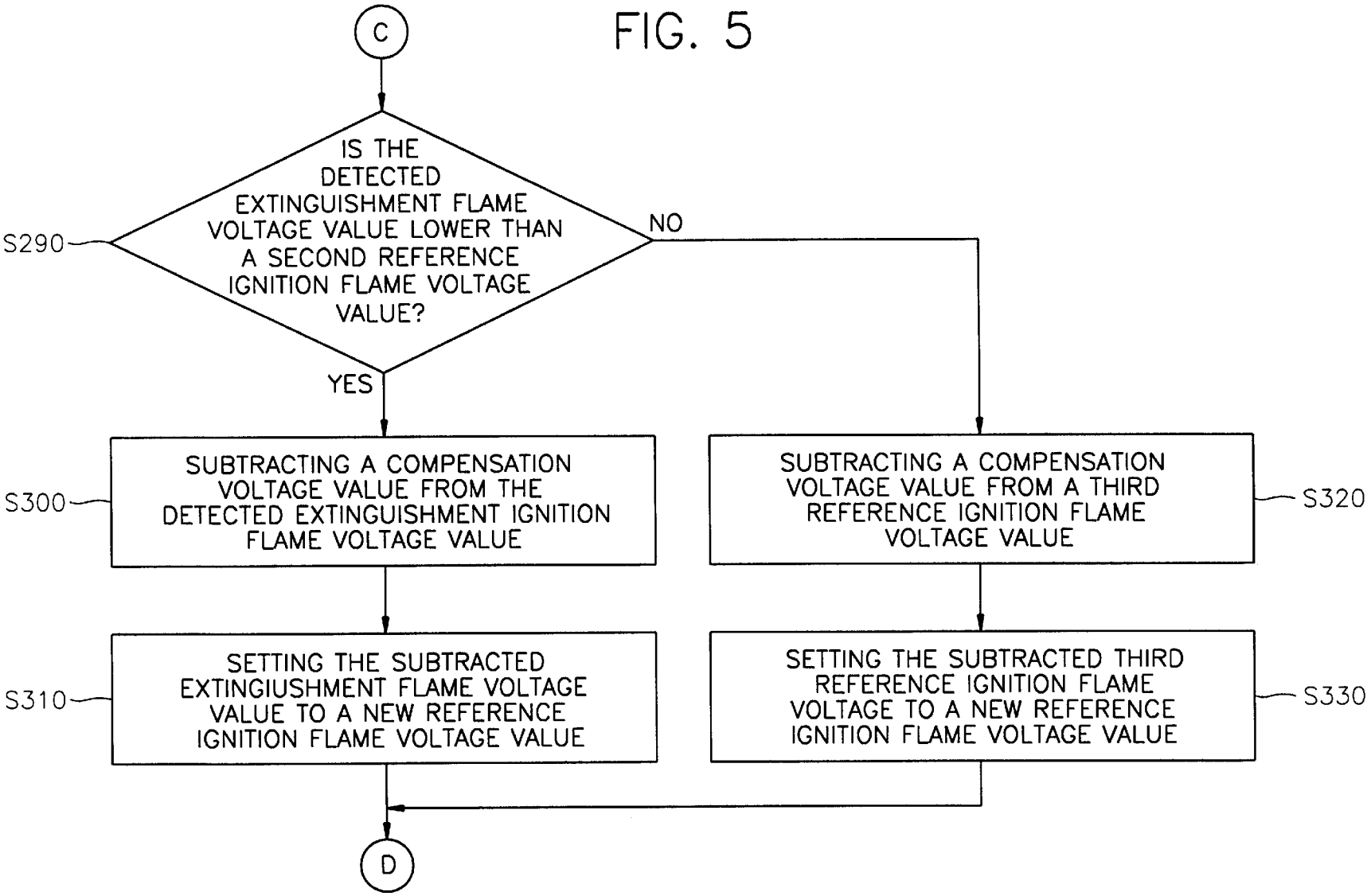

FIGS. 3 to 5 are a flowchart for illustrating a method for controlling an ignition of a gas boiler by using the apparatus which is shown in FIG. 2.

As shown in FIGS. 3 to 5, control section 140 executes the ignition operation of the gas boiler based either on a user's key operation of key inputting section 100 or on an abnormal extinguishment state of the gas boiler (step S200).

In step S210, control section 140 detects ignition flame voltage value 111*a* in the ignition operation executed in step 200 via flame voltage detector 110.

Control section 140 compares ignition flame voltage value 111*a* detected in step S210 with the predetermined reference ignition flame voltage value (step S220). At this time, the predetermined reference ignition flame voltage value is set to 4.5 volts.

When it is judged in step S220 that ignition flame voltage value 111*a* detected in step S210 is higher than the predetermined reference ignition flame voltage value, control section 140 detects extinguishment flame voltage value 111*c* of the gas boiler via flame voltage detector 110 (step S230).

When it is judged in step S220 that ignition flame voltage value 111*a* detected in step S210 is not higher than the predetermined reference ignition flame voltage value, control section 140 executes the normal combustion operation of the gas boiler (step S240).

Control section 140 detects combustion flame voltage value 111*b* of the gas boiler in the normal combustion operation state via flame voltage detector 110 (step S250).

Control section 140 compares combustion flame voltage value 111*b* detected in step S250 with the predetermined reference ignition flame voltage value (step S260).

When it is judged in step S260 that combustion flame voltage value 111*b* detected in step S250 is not higher than the predetermined reference ignition flame voltage value, the gas boiler executes the normal combustion operation (step S240).

When it is judged in step S260 that combustion flame voltage value 111*b* detected in step S250 is higher than the predetermined reference ignition flame voltage value, control section 140 detects extinguishment flame voltage value 111*c* of the gas boiler via flame voltage detector 110 (step S230).

Control section 140 compares extinguishment flame voltage value 111*c* detected in step S230 with the predetermined first reference ignition flame voltage value (step S270). At this time, the predetermined first reference ignition flame voltage value is set to 4.5 volts.

When it is judged in step S270 that extinguishment flame voltage value 111*c* detected in step S230 is not higher than the predetermined first reference ignition flame voltage value, control section 140 sets the predetermined first reference ignition flame voltage value to the new reference ignition flame voltage value, and returns to step S200 (step S280).

When it is judged in step S270 that extinguishment flame voltage value 111*c* detected in step S230 is higher than the predetermined first reference ignition flame voltage value, control section 140 compares extinguishment flame voltage value 111*c* detected in step S230 with the predetermined second reference ignition flame voltage value (step S290). At this time, the predetermined second reference ignition flame voltage value is set to 5 volts.

When it is judged in step S290 that extinguishment flame voltage value 111*c* detected in step S230 is lower than the predetermined second reference ignition flame voltage value, control section 140 subtracts the predetermined compensation voltage value from extinguishment flame voltage value 111*c* detected in step S230 (step S300). At this time, the predetermined compensation voltage value is set to 0.2 volts.

Control section 140 sets the extinguishment flame voltage value subtracted in step S300 to the new reference ignition flame voltage value and returns to step S200 (step S310).

When it is judged in step S290 that extinguishment flame voltage value 111*c* detected in step S230 is not lower than the predetermined second reference ignition flame voltage value, control section 140 subtracts the predetermined compensation voltage value from the predetermined third reference ignition flame voltage value (step S320). At this time, the predetermined third reference ignition flame voltage value is set to 4.8 volts.

Control section 140 sets the third reference ignition flame voltage value subtracted in step S320 to the new reference ignition flame voltage value and returns to step S200 (step S330).

In the method and apparatus for controlling an ignition of a gas boiler according to the present invention, the reference ignition flame voltage value of the gas boiler is variably set according to the combustion flame voltage value detected from a combustion state of the gas boiler and to the extinguishment flame voltage value detected from an extinguishment state of the gas boiler.

Accordingly, the effects on the variations of the components' characteristic which occur while using the gas boiler for a long time are minimized. Also, the effects caused by external conditions in the ignition state, the combustion state and the extinguishment state of the gas boiler are minimized. As a result, the ignition operation of the gas boiler is stably executed.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A method for controlling an ignition of a gas boiler, said method comprising the steps of:

(A) executing an ignition operation;

(B) detecting an ignition flame voltage value;

(C) comparing the ignition flame voltage value detected in step (B) with a predetermined reference ignition flame voltage value;

(D) detecting an extinguishment flame voltage value when the ignition flame voltage value detected in step (B) is higher than the predetermined reference ignition flame voltage value;

(E) executing a normal combustion operation when the ignition flame voltage value detected in step (B) is not higher than the predetermined reference ignition flame voltage value;

(F) detecting a combustion flame voltage value;

(G) comparing the combustion flame voltage value detected in step (F) with the predetermined reference ignition flame voltage value;

(H) returning to step (D) when the combustion flame voltage value detected in step (F) is higher than the predetermined reference ignition flame voltage value;

(I) returning to step (E) when the combustion flame voltage value detected in step (F) is not higher than the predetermined reference ignition flame voltage value;

(J) comparing the extinguishment flame voltage value detected in step (D) with a first reference ignition flame voltage value;

(K) setting the first reference flame voltage value to a new reference ignition flame voltage value when the extinguishment flame voltage value detected in step (D) is not higher than the first reference ignition flame voltage value;

(L) comparing the extinguishment flame voltage value detected in step (D) with a second reference ignition flame voltage value when the extinguishment flame voltage value detected in step (D) is higher than the first reference ignition flame voltage value;

(M) subtracting a compensation voltage value from the extinguishment flame voltage value detected in step (D) when the extinguishment flame voltage value detected in step (D) is lower than the second reference ignition flame voltage value;

(N) setting the extinguishment flame voltage value subtracted in step (M) to the new reference ignition flame voltage value and returning to step (A);

(O) subtracting the compensation voltage value from a third reference ignition flame voltage value when the extinguishment flame voltage value detected in step (D) is not lower than the second reference ignition flame voltage value; and (P) setting the third reference ignition flame voltage value subtracted in step (O) to the new reference ignition flame voltage value and returning to step (A).

2. The method for controlling an ignition of a gas boiler as claimed in claim 1, wherein said predetermined reference ignition flame voltage value and said first reference ignition flame voltage value are equally 4.5 volts.

3. The method for controlling an ignition of a gas boiler as claimed in claim 1, wherein said second reference ignition flame voltage value is 5 volts.

4. The method for controlling an ignition of a gas boiler, as claimed in claim 1, wherein said third reference ignition flame voltage value is 4.8 volts.

5. The method for controlling an ignition of a gas boiler as claimed in claim 1, wherein said compensation voltage value is 0.2 volts.

6. An apparatus for controlling an ignition of a gas boiler, said apparatus comprising:

key inputting means for generating operation setting signals in response to a key operation from a user;

flame voltage detecting means for detecting and for generating an ignition flame voltage value, an extinguishment flame voltage value and a combustion flame voltage value of the gas boiler;

control means for generating either a gas supply starting signal or a gas supply stopping signal in response to the operation setting signals from said key inputting means, for generating a high voltage to generate an igniting spark, for inputting the ignition flame voltage value, the extinguishment flame voltage value and the combustion flame voltage value from said flame voltage detecting means, for executing a re-ignition operation based on a result produced by respectively comparing the inputted ignition flame voltage value and the combustion flame voltage value with a predetermined reference ignition flame voltage value, and for setting to a new reference ignition flame voltage value to execute the re-ignition operation of the gas boiler, either the first reference ignition flame voltage value, or an extinguishment flame voltage value produced by subtracting a compensation voltage value from the extinguishment flame voltage value supplied from said flame voltage detecting means or a third reference ignition flame voltage value produced by subtracting the compensation voltage value from a third reference ignition flame voltage value based on a result produced by respectively comparing the extinguishment flame voltage value from said flame voltage detecting means with first and with second reference ignition flame voltage values during the re-ignition operation;

means for supplying gas to the gas boiler in response to the gas supply starting signal from said control means, and for stopping gas supplied to the gas boiler in response to the gas supply stopping signal from said control means; and ignition plug means for generating the igniting spark of the gas boiler in response to the high voltage from said control means.

7. The apparatus for controlling an ignition of a gas boiler as claimed in claim 6, wherein said predetermined reference ignition flame voltage value and said first reference ignition flame voltage value are equally 4.5 volts.

8. The apparatus for controlling an ignition of a gas boiler as claimed in claim 6, wherein said second reference ignition flame voltage value and said third reference ignition flame voltage value are 5 volts and 4.8 volts, respectively.

9. The apparatus for controlling an ignition of a gas boiler as claimed in claim 6, wherein said compensation voltage value is 0.2 volts.

* * * * *